US010604402B2

(12) United States Patent
Cloutier

(10) Patent No.: US 10,604,402 B2
(45) Date of Patent: Mar. 31, 2020

(54) FACILITY FOR STORING AND DISPENSING FUEL

(71) Applicant: TOKHEIM HOLDING B.V., Bladel (NL)

(72) Inventor: Philippe Cloutier, May/Orne (FR)

(73) Assignee: TOKHEIM HOLDING B.V., Bladel (NL)

( * ) Notice: Subject to any disclaimer, the term of this patent is extended or adjusted under 35 U.S.C. 154(b) by 25 days.

(21) Appl. No.: 16/300,246

(22) PCT Filed: May 10, 2017

(86) PCT No.: PCT/EP2017/061154
§ 371 (c)(1),
(2) Date: Nov. 9, 2018

(87) PCT Pub. No.: WO2017/194588
PCT Pub. Date: Nov. 16, 2017

(65) Prior Publication Data

US 2019/0144258 A1 May 16, 2019

(30) Foreign Application Priority Data

May 10, 2016 (FR) ..... 1654157

(51) Int. Cl.
*B67D 7/76* (2010.01)
*B67D 7/04* (2010.01)

(52) U.S. Cl.
CPC ..... *B67D 7/0488* (2013.01); *B67D 7/049* (2013.01); *B67D 7/766* (2013.01); *B67D 2007/0494* (2013.01)

(58) Field of Classification Search
CPC ..... B67D 7/0488; B67D 7/766; B67D 7/049; B67D 2007/0494
See application file for complete search history.

(56) References Cited

FOREIGN PATENT DOCUMENTS

FR 299553 * 12/2012 ..... B67D 7/04
WO WO-2010150005 A1 * 12/2010 ..... B67D 7/0488

* cited by examiner

*Primary Examiner* — Craig M Schneider
*Assistant Examiner* — Jason K Niesz
(74) *Attorney, Agent, or Firm* — Fish & Richardson P.C.

(57) ABSTRACT

A facility for storing and dispensing fuel, comprising:

Figure 1:
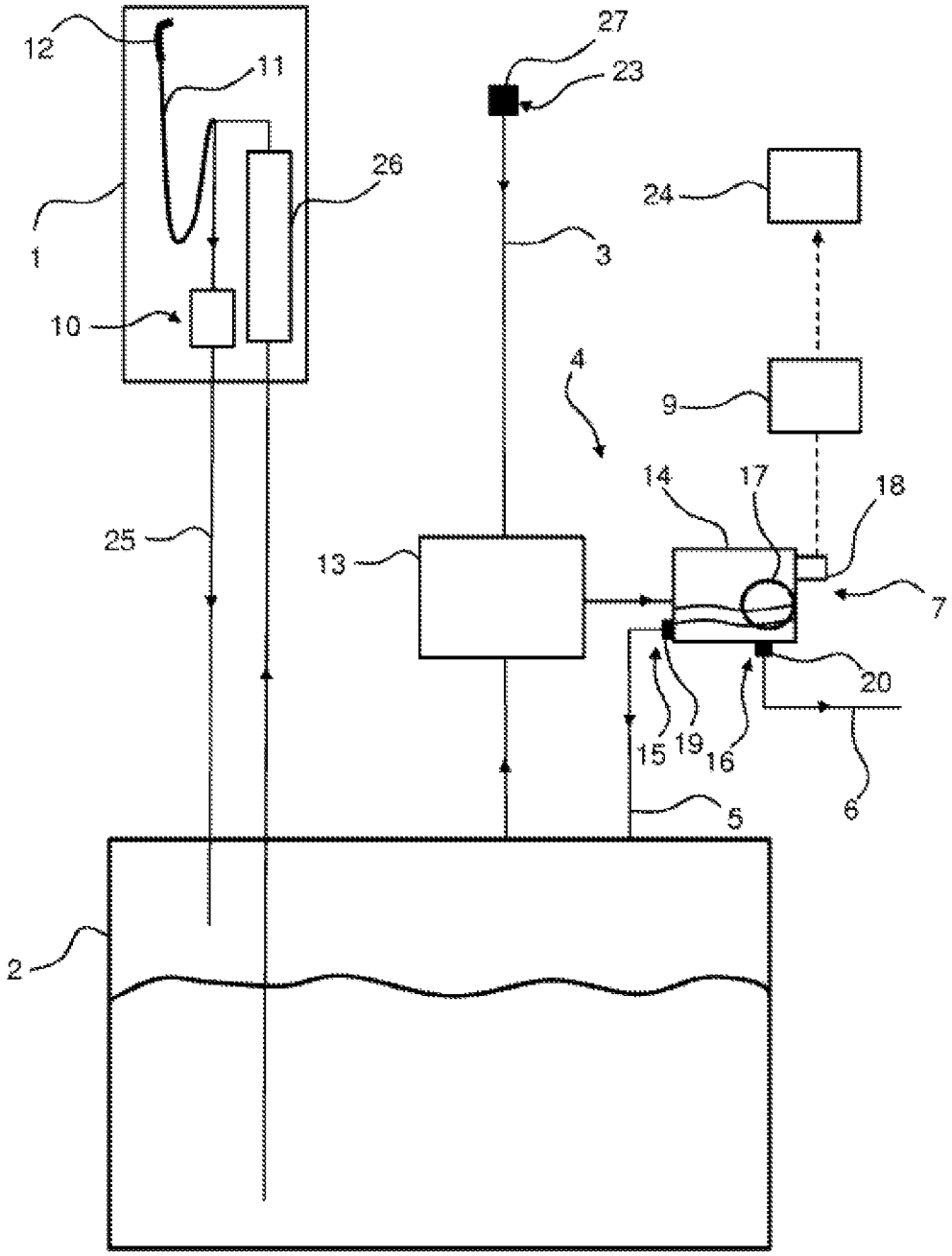

a storage tank (2) equipped with a vent pipe (3) and connected to a fuel dispenser (1) by a fuel dispensing system and by a vapor recovery system (10), and a condensation/separation device (4) connected to the vent pipe (3) and allowing fuel vapor originating from the storage tank (2) and water vapor originating from the outside air to be condensed, characterized in that it comprises:

at least one detection means (7, 8) cooperating with the condensation/separation device (4) for detecting the presence of condensed fuel and/or condensed water in said device and generating and transmitting a warning signal in response to said detection, and a control device (9) receiving said warning signal and transmitting, in response, information concerning the malfunction of the fuel vapor recovery system (10) to a control center (24).

9 Claims, 3 Drawing Sheets

FACILITY FOR STORING AND DISPENSING FUEL

CROSS REFERENCE TO RELATED APPLICATIONS

This application is a National Stage Application under 35 U.S.C. § 371 and claims the benefit of International Application No. PCT/EP2017/061154, filed May 10, 2017 which claim priority to French Application No. 1654157 filed May 10, 2016. The disclosure of the foregoing applications are hereby incorporated by reference in their entirety.

The present invention relates to a facility for storing and dispensing fuel for motor vehicles, such as a service station.

Such a facility comprises a fuel storage tank equipped with a vent pipe and connected to at least one fuel dispenser comprising a hose connected to a dispensing nozzle, on the one hand by a fuel dispensing system in a vehicle tank and on the other hand by a vapor recovery system aspirating the fuel vapor emitted during a dispensing of fuel in a tank.

Service stations are traditionally equipped with tanks able to store so-called light fuels such as lead-free gasoline SP 95 or SP 98, for example.

The gas phase of the light fuel may contain between 40 and 90% by volume of volatile organic compounds (VOC), some of which are very harmful to human health; the gas complement is air loaded with water vapor or humidity.

It is thus very important to be able to prevent any emission of VOC into the atmosphere, especially VOC generated entirely by light fuels during operations of refilling the fuel tanks and dispensing fuel.

At the service stations each fuel storage tank, which is generally buried, is equipped with a vent pipe having a valve to prevent said tank being placed under excess pressure or partial vacuum and to balance out its pressure according to whether it is in partial vacuum or excess pressure.

A European regulation known a "phase II recovery" requires the recovery of fuel vapor emitted outside the tank of a vehicle during its refilling in order to avoid an emission of gas phase containing hydrocarbons.

For this purpose, the facilities for storage and dispensing of fuel are equipped with a vapor recovery system having a gas phase collection conduit working by aspiration and extending from the nozzle of the fuel dispenser to the storage tank.

This vapor recovery system comprises a pump to aspirate the vapor and a flow rate meter, able to measure the flow rate of the aspirated vapor.

A control system makes it possible to control and adjust the flow rate of the aspirated vapor so that the volume ratio of fuel dispensed and vapor recovered is as close as possible to 1.

In fact, the liquid fuel transferred to the tank of a vehicle drives out from that tank a volume of fuel vapor equivalent to the liquid fuel delivered, being aspirated by the fuel vapor recovery system; in theory, the volume of the aspirated gas phase is thus identical to the volume of liquid fuel delivered into the tank of the vehicle, although this is not always the case in practice.

In fact, it often happens that the vapor recovery system does not work properly and the aforementioned theoretical ratio of 1 is not attained.

Thus, this results in an excess pressure or a partial vacuum in the storage tank with a rebalancing by the vent pipe; this rebalancing generates either an emission of gas phase laden with hydrocarbons to the outside when the tank is under excess pressure, or an entry of air from the outside, laden with humidity, into the tank when the tank is under partial vacuum.

These phenomena are further amplified by the presence of significant temperature differences between the storage tank and the ambient air, as is often the case during times of intense heat associated with high relative humidity of the air.

In the case of a partial vacuum, air is aspirated through the vent and water vapor is thus transferred from the outside into the storage tank by the vent pipe to make possible the compensation or the rebalancing of the pressure in that tank.

Humidity may likewise be transferred into the storage tank by the return of the aspirated gas phase in the tanks of vehicles, which are themselves in contact with the outside air and thus laden with humidity.

Hence, the result is a presence of air laden with humidity in the fuel storage tanks.

This humidity has the drawback of causing corrosion of the walls of the tank which, in the end, may become perforated, spilling fuel into the subsoil and causing a not insignificant pollution.

Moreover, this humidity may result in a freezing of the water in the presence of negative temperatures with a risk of blocking the vent lines or the fuel dispensing lines.

In the case of excess pressure in the tank, a gas phase laden with hydrocarbons is emitted into the atmosphere via the vent pipe, causing pollution.

To remedy these drawbacks, it has already been proposed to equip the facilities for storing and dispensing of fuel with a condensation/separation device connected to the vent pipe of the storage tank and making it possible to condense the fuel vapor coming from the storage tank in order to generate condensed fuel and to condense the water coming from the outside air in order to generate condensed water; said condensation/separation device being connected to the storage tank and to a condensed water evacuation line to the outside, in particular to the spent water mains.

As an example, there has already been proposed according to the document WO 2014 096 596 a light fuel storage and dispensing facility able to both recover gaseous hydrocarbons resulting from light fuels by refrigeration type condensation at subzero temperature and to dehumidify the outside air during the storing and dispensing of fuels.

This fuel storage and dispensing facility comprises in particular a condenser to condense the fuel vapor coming from the storage tank and a dehumidifier for the outside air admitted into this tank.

This facility is thus able to prevent pollution outside of the storage tank and to prevent a contamination of the fuel of this tank with water, in event of its excess pressure or partial vacuum.

However, this facility is not able to identify the problem causing said excess pressure or partial vacuum in the storage tank and in particular it is not able to detect a malfunction of the fuel vapor recovery system, in particular to detect a leak in the channel connecting the dispensing nozzle to the storage tank.

The purpose of the present invention is to remedy these drawbacks by proposing a fuel storage and dispensing facility of the aforementioned kind which is able to recover the gaseous hydrocarbons emanating from the storage tank and to prevent the contamination of said tank with water emanating from the outside air, while making it possible to detect malfunctions of the fuel vapor recovery system.

According to the invention, this fuel storage and dispensing facility comprises at least one fuel dispenser having a hose connected to a dispensing nozzle, which is connected to a fuel storage tank, and a fuel vapor recovery system aspirating the fuel vapor emitted during a dispensing of fuel in a vehicle tank.

The fuel vapor recovery system is connected to the fuel storage tank.

The facility also comprises a vent pipe connected on the one hand to the fuel storage tank and on the other hand to a condensation/separation device able to condense fuel vapor coming from the storage tank in order to generate condensed fuel and to condense water coming from the outside air in order to generate condensed water.

The condensation/separation device is connected to a condensed fuel evacuation line connected to the fuel storage tank and to a condensed water evacuation line, connected to the outside of the fuel tank.

According to the invention, this fuel storage and dispensing facility is characterized in that it comprises:

at least one detection means cooperating with the condensation/separation device for detecting the presence of condensed fuel and/or condensed water in said device and generating and transmitting a warning signal in response to said detection, and a control device receiving said warning signal and transmitting, in response, information concerning the malfunction of the fuel vapor recovery system to a control center.

This control center may be situated in the fuel dispenser, in the kiosk of the service station, or at a distance from the service station; a remote command center may be provided, linked to multiple control centers of multiple service stations.

According to a first embodiment of the invention, the condensation/separation device comprises on the one hand a condenser which condenses at the same time the fuel vapor coming from the storage tank and the water coming from the outside air and on the other hand a separator connected to said condenser and comprising two outlets, namely, a first outlet connected to the condensed fuel evacuation line and a second outlet connected to the condensed water evacuation line.

The condenser which is connected to the vent circuit and which condenses the fuel and water vapors at the same time thus provided at its output a mixture of condensed fuel and water, and it operates preferably at a temperature of around −2° C. to avoid the accumulation of ice, and it generally comprises a channeling in which there circulates a fluid cooled by a compressor.

The separator, which is connected to the condenser, makes it possible to separate the condensed water from the condensed fuel which, being lighter, floats on top of the latter.

According to this first embodiment of the invention, the two outlets of the separator are each equipped with an automatically controlled valve cooperating with a condensate detector making it possible to detect the nature of the condensate contained in this separator, namely, a first valve able to open or close the first outlet connected to the condensed fuel evacuation line and a second valve able to open or close the second outlet connected to the condensed water evacuation line, according to the nature of the condensate detected.

The condensate detector makes it possible to detect the nature or the density of the condensate (water or hydrocarbons).

When the nature or the density of the condensate has been detected, the appropriate valve can be opened to evacuate either the hydrocarbons to the storage tank by the condensed fuel evacuation line or the water, in particular to the spent water mains, by the condensed water evacuation line.

The condensate detector in particular makes it possible to detect the density of the condensate; the density of the hydrocarbons and the density of the water being different, this detector is thus able to differentiate between these liquids.

The condensate detector may likewise be an optical infrared detector.

According to a second embodiment of the invention, the condensation/separation device comprises on the one hand a fuel vapor condenser able to condense the fuel vapor coming from the storage tank and having an outlet connected to the condensed fuel evacuation line, and on the other hand a dehumidifier able to condense the water coming from the outside air and having an outlet connected to the condensed water evacuation line.

The condenser and the dehumidifier are connected in series to the vent pipe, the condenser being located upstream from the dehumidifier in the direction of circulation of the fuel vapor coming from the storage tank.

According to this second embodiment of the invention, the condenser of fuel vapor, which works at lower temperatures than the dehumidifier, substantially condenses only the fuel vapor coming from the storage tank, which is evacuated at once by the condensed fuel evacuation line.

Very little fuel vapor leaves the fuel vapor condenser in the direction of the dehumidifier, making it possible to condense the water from the air aspirated into the vent pipe.

This water, so condensed, is evacuated by the condensed water evacuation line.

The facility according to this second embodiment of the invention is in fact simpler than that corresponding to the first embodiment insofar as it allows one to avoid the use of a hard to manage separator and to avoid the pollution of the evacuation lines with the respective condensates.

According to the first embodiment of the invention, the facility may comprise a single detection means or two detection means.

According to a first variant of this first embodiment, this detection means may be composed of a volume meter, such as a flow meter installed between the condenser and the separator and generating and transmitting a warning signal in response to the measurement of a volume of condensed fuel or condensed water.

According to a second variant of this first embodiment of the invention, one or two detection means may be installed in the separator, generating and transmitting a warning signal in response to the detection of a predefined volume of condensate in this separator.

Such a detection means may, for example, be composed of a gauge having a float with a buoyancy adapted to float in the fuel and in the water and equipped with a magnet, cooperating with a magnetic contactor positioned at a high level so that when the float reaches this high level the contactor detects the presence of the float and transmits a warning signal to the control device which commands in parallel the opening of the valve at the appropriate exit of the separator to enable the evacuation of the condensed fuel or the condensed water contained in this separator.

Such a float can thus move between a low level and a high level, defining a known volume V.

The volume V between the low level and the high level being known, each activation of the contactor transmits to the control device information as to the volume V of condensate evacuated.

In other words, each warning signal or pulse transmitted to the control device generates information about the volume.

Each pulse is associated with a volume V and a number n of pulses corresponds to a total volume of condensate detected by the detection means Vt=nV.

According to the first embodiment of the invention, the detection means installed in the separator may also be a gauge provided with two floats having two different densities, namely, one density adapted to float in the fuel and one density adapted to float in the water, these two floats cooperating with two different contactors.

In a variant, the separator may comprise two magnetostrictive probes, namely, a first probe having a density adapted to float in the fuel and a second probe having a float adapted to float in the water, but not in the fuel.

The magnetostrictive probes, which are familiar in themselves and which can indicate a volume in real time, are particularly suited to the case when the separator contains a mixture of fuel and water.

The relative positions of the probes with respect to each other make it possible to know the level of each condensate and to actuate the opening and closing of the valves in consequence.

In fact, if the separator contains only water, once there has been a recuperation of the fuel vapor, the two floats are basically at the same level.

The control device then commands only the opening of the second valve to evacuate the condensed water, in particular to the spent water mains.

If the separator contains water and fuel, the float of the first probe is positioned higher than the float of the second probe.

The control device is then notified as to the presence of the two phases and it first commands the opening of the second valve to evacuate the water which is denser than the fuel.

When the water has been evacuated, the float of the second water probe reaches its lowest level and remains there, since it does not float in the fuel; as for the float of the first probe for fuel, this is positioned on top of the float assigned to the water.

The control device recognizes the relative positions of the two floats and then commands the closing of the second valve and the opening of the first valve to evacuate the fuel.

Thus, this embodiment, making use of two magnetostrictive probes, is able to both detect an abnormal functioning of the vapor recovery system, measure the volumes of condensates, since the position of the probes in the separator corresponds to a given volume, and also control automatically the opening of the valves.

According to another characteristic of the invention which may be applied to the first embodiment and to the second embodiment, the facility comprises two detection means, namely, a first detection means connected to the condensed fuel evacuation line and generating and transmitting a warning signal for excess pressure in response to the detection of condensed fuel in the condensed fuel evacuation line and a second detection means connected to the condensed water evacuation line and generating and transmitting a warning signal for underpressure in response to the detection of condensed water in the condensed water evacuation line.

The detection of condensate by the first detection means makes it possible to know that the storage tank is under excess pressure and thus that the fuel vapor recovery system is recovering a greater volume of fuel vapor than the volume of fuel delivered to the tank of the vehicle; hence, a malfunction is present.

On the other hand, when the storage tank is under partial vacuum, air is aspirated by the vent pipe and condensed water is evacuated by the condensed water evacuation line and detected by the second detection means, which generates a warning signal for underpressure which is sent to the control device.

A malfunction message is then sent to the control center.

These means of detection may be composed of volume meters such as flow meters generating and transmitting a warning signal in response to the measuring of a volume of condensed fuel or condensed water.

These means of detection may likewise each comprise a gauge lodged in a receptacle connected to the condensed fuel evacuation line or to the condensed water evacuation line and having one inlet and one outlet.

Each gauge comprises a float cooperating with a contactor positioned at a high level.

When the float reaches the high level, it activates the contactor and a valve opens the outlet of the receptacle connected to the condensed fuel evacuation line or the receptacle connected to the condensed water evacuation line.

The volume V between the low level and the high level being known, each activation of a contactor sends a message to the control device that a volume V of condensate has been evacuated.

In other words, each warning signal or pulse transmitted to the control device generates a volume message.

Each pulse is associated with a volume V, and thus a number n of pulses corresponds to a total volume of condensate detected by the detection means Vt=nV.

The use of a flow meter in a variant also makes it possible to know the volume of condensate recovered.

During a defined period of time, the larger the volume of condensate and the greater the malfunctioning of the fuel vapor recovery system, the more the volume of fuel delivered to the vehicle will differ from the volume of recovered fuel vapor.

If the fuel vapor recovery system inside the fuel dispenser is controlled and functioning normally, a malfunction detected by the means of detection means that the conduit of the fuel vapor recovery system situated between the fuel dispenser and the fuel tank has a leak.

The volumes of condensate calculated make it possible to know approximately the magnitude of this leak, and primarily the volume of fuel vapor lost.

The invention also makes it possible to detect abnormal losses of liquid fuel.

In fact, it is possible to know approximately the volume of air aspirated into the vent pipe as a function of the volume of condensed water, given the proportion of water in the air and the density of water.

The volume of air aspirated is equivalent to the volume of fuel vapor not recovered in the storage tank and which should have been recovered.

Hence, there is more liquid fuel delivered by the fuel dispenser and thus aspirated into the fuel storage tank than vapor recovered in the fuel storage tank.

The measured volume of condensed water then allows an approximate quantification of the loss of liquid fuel.

In event of a proper functioning of the fuel vapor recovery system, this loss may be due to a fuel leak or to fraudulent fuel deliveries.

In theory, and as already pointed out, the volume of fuel aspirated into the fuel storage tank corresponds to the volume of fuel vapor recovered in the storage tank by the fuel vapor recovery system and the volume of air aspirated by the vent pipe.

The difference between the volume of fuel aspirated and calculated by this method and the volume of fuel delivered and measured by the fuel meter dispenser allows a calculation of the volume of fuel lost abnormally.

Figure 2:
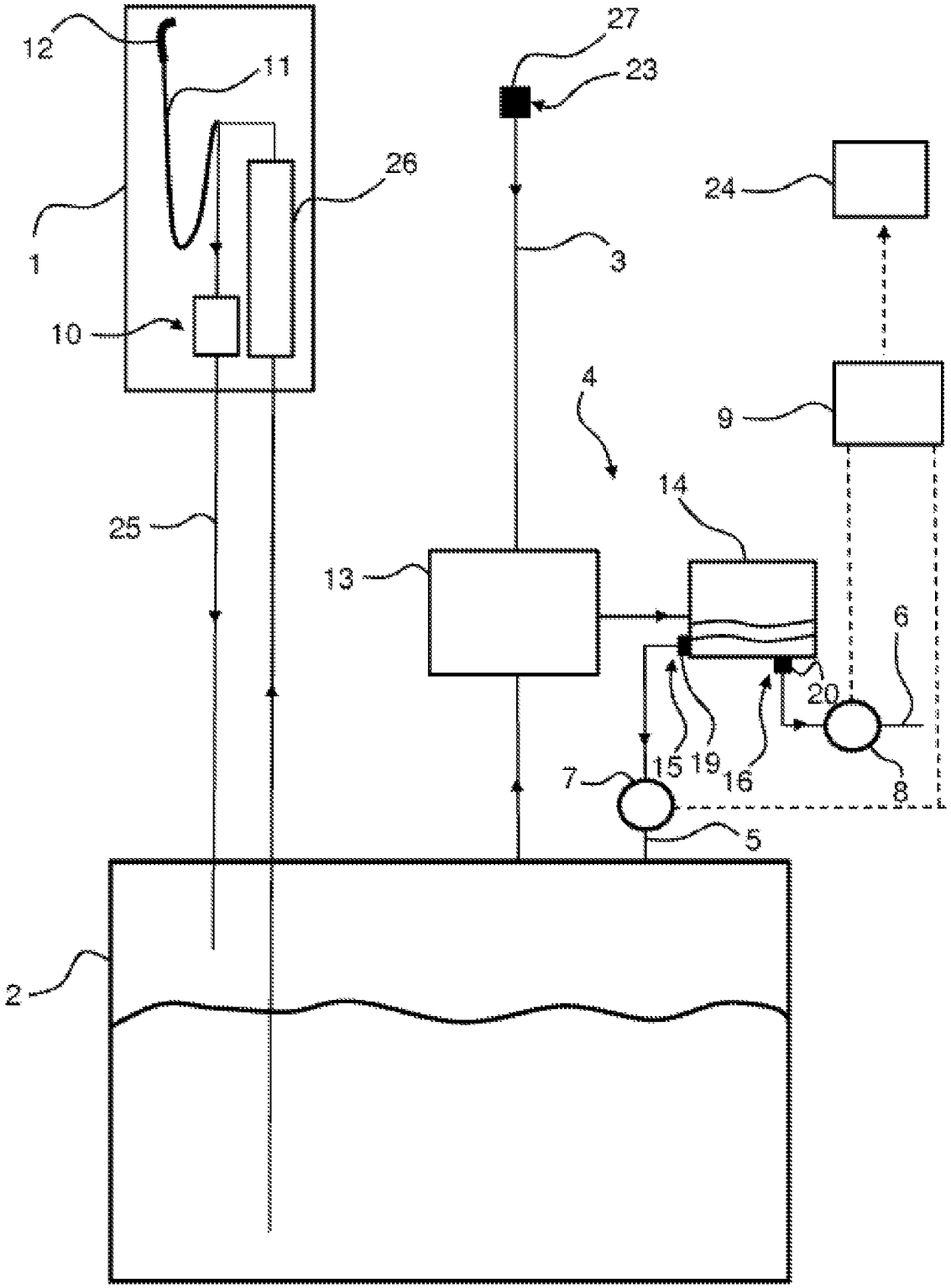
Figure 3:
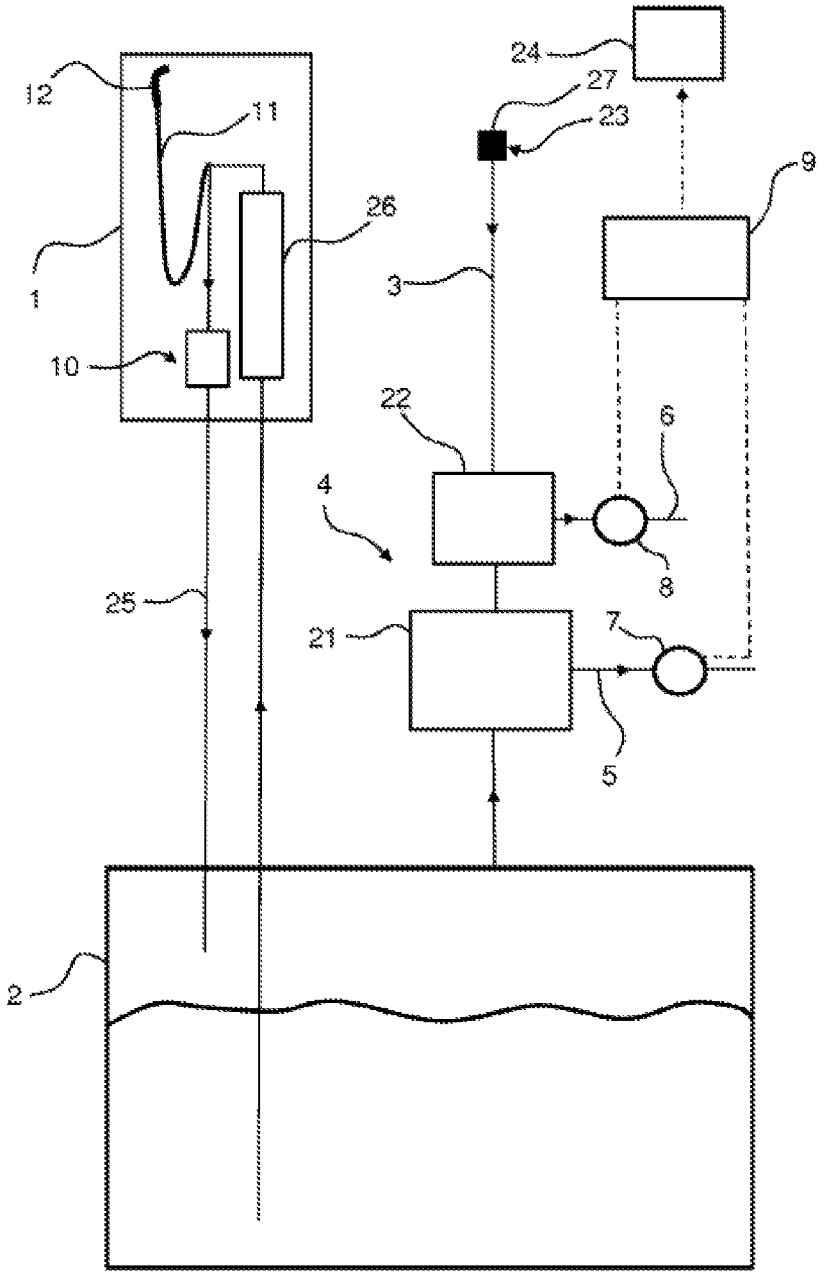

The characteristics of the facility which is the subject of the invention shall be described in further detail with reference to the nonlimiting drawings appended herewith, in which:

FIG. 1 represents schematically a fuel storage and dispensing facility for a vehicle according to a first variant of the first embodiment of the invention, FIG. 2 represents schematically a fuel storage and dispensing facility corresponding to a second variant of the first embodiment of the invention, FIG. 3 represents schematically a fuel storage and dispensing facility for a vehicle corresponding to the second embodiment of the invention.

According to FIGS. 1, 2 and 3, the fuel storage and dispensing facility for a vehicle comprises a fuel dispenser 1 having a hose 11 connected to a nozzle 12.

The fuel dispenser 1 is connected to a fuel storage tank 2 which is generally underground.

The fuel dispenser 1 traditionally comprises a fuel dispensing system 26 having a pump unit aspirating fuel from the fuel storage tank 2 and a flow meter measuring the flow rate of fuel delivered.

The fuel storage and dispensing facility further comprises a fuel vapor recovery system 10 making it possible to aspirate the fuel vapor emitted during a dispensing of fuel in the tank of a vehicle.

The liquid fuel transferred to the tank of the vehicle drives out from this tank a volume of fuel vapor equivalent to the volume of liquid fuel delivered, which is aspirated by the fuel vapor recovery system 10.

The fuel vapor recovery system 10 is connected to the fuel storage tank 2 by a recovery line 25 so as to transfer the aspirated fuel vapor to the storage tank 2.

The fuel vapor recovery system 10 traditionally comprises a pump to aspirate the fuel vapor and a flow meter allowing a measuring of the flow rate of aspirated vapor.

A control system makes it possible to control and adjust the flow rate of aspirated vapor so that the ratio of the distributed fuel volume to the recovered vapor volume is as close as possible to 1.

The facility further comprises a vent pipe 3 connected on the one hand to the fuel storage tank 2 and on the other hand to a condensation/separation device 4 making it possible to condense fuel vapor coming from the storage tank 2 in order to generate condensed fuel and to condense water coming from the outside air in order to generate condensed water.

The vent pipe 3 comprises a valve 27 and a flame arrester at its outer end 23.

The condensation/separation device 4 is connected to a condensed fuel evacuation line 5 which is connected to the storage tank 2 and to a condensed water evacuation line 6 which is connected to the spent water mains.

The condensation/separation device 4 is able to condense the hydrocarbons expelled by the storage tank 2 when there is an excess pressure in this tank, in order to avoid environmental pollution.

This device 4 is also able to trap the air aspirated by the vent pipe 3 when there is an underpressure in the storage tank in order to avoid having water in this tank.

The facility for storing and dispensing of fuel likewise comprises at least one detection means which shall be described in greater detail below, and which cooperates with the condensation/separation device 4 to detect the presence of condensed fuel and/or water in this facility and to generate and transmit a warning signal in response to said detection.

This warning signal is transmitted to a control device 9 which transits in response a message of malfunction of the vapor recovery system 10 to a control center 24.

The detection means and the control device thus constitute a device for monitoring of the vapor recovery system 10, making it possible to alert the operator in event of a malfunction so as to allow an intervention to correct said malfunction.

According to FIGS. 1 and 2, the condensation/separation device 4 comprises a condenser 13 connected to the vent pipe 3 and condensing both the fuel vapor coming from the fuel storage tank 2 and the water coming from the outside air.

The condenser 13 is connected to a separator 14 which separates the hydrocarbon phase from the aqueous phase.

This separator 14 has two outlets 15, 16, namely, a first outlet 15 connected to the condensed fuel evacuation line 5 and a second outlet 16 connected to the condensed water evacuation line 6.

The two outlets 15, 16 of the separator 14 each comprise an automatically controlled valve 19, 20, namely, a first valve 19 opening or closing the first outlet 15 connected to the condensed fuel evacuation line 5 and a second valve 20 opening or closing the second outlet 16 connected to the condensed water evacuation line 6.

The separator 14 likewise comprises a condensate detector, not shown in the figures, able to detect the nature (water or hydrocarbons) of the condensate contained therein.

When the nature of this condensate has been detected, the appropriate valve 19, 20 may be opened to evacuate either fuel to the storage tank 2 by the condensed fuel evacuation line 5 or water to the spent water mains by the condensed water evacuation line 6.

According to FIG. 1, the detection means 7 is mounted in the separator 14 and comprises a gauge transmitting a warning signal when a high level of condensate is detected in the separator 14.

This gauge comprises a float 17 having a buoyancy adapted to float in fuel and water.

The water contained in the separator 14 may come from the air aspirated by the vent pipe 3, but also from fuel vapor aspirated by the fuel vapor recovery system 10 which also aspirates a bit of air.

The float 17 is equipped with a magnet, activating a magnetic contactor 18 positioned at a high level.

When the float 17 reaches this high level, the contactor 18 detects the presence of the float 17 and transmits a warning signal to the control device 9.

According to FIG. 2, the facility comprises a first detection means 7 connected to the condensed fuel evacuation line 5 in order to detect the presence of condensed fuel and a second detection means 8 connected to the condensed water evacuation line 6 to detect the presence of condensed water.

The first detection means 7 generates a warning signal of excess pressure in response to the detection of condensed fuel, while the second detection means 8 generates a warning signal of underpressure in response to the detection of condensed water.

The detection means 7, 8 are composed of gauges lodged in a receptacle equipped with a valve connected to an outlet of this receptacle.

In a manner not represented, each gauge comprises a float which can move between a high level and a low level and cooperating with a contactor positioned at the high level.

When the float reaches the high level, it activates the contactor and the valve opens the outlet of the receptacle corresponding to the first detection means 7 or to the second detection means 8.

The volume V between the low level and the high level being known, each activation of the contactor generates information as to the volume V of condensate evacuated, which is sent to the control device 9.

According to FIG. 3, the condensation/separation device 4 comprises a fuel vapor condenser 21 to condense the fuel vapor arriving in the storage tank 2 and a dehumidifier 22 to condense the water coming from the outside air.

The condenser 21 and the dehumidifier 22 are connected in series with the vent pipe 3, and the condenser 21 is situated upstream from the dehumidifier 22 in the direction of circulation of the fuel vapor coming from the storage tank 2.

The condenser 21 comprises an outlet connected to the condensed fuel evacuation line 5 while the dehumidifier 22 comprises an outlet connected to the condensed water evacuation line 6.

A first detection means 7 is mounted on the condensed fuel evacuation line 5 and a second detection means 8 is connected to the condensed water evacuation line 6.

These detection means 7, 8 are identical to those described above with respect to FIG. 2.

The invention thus provides a fuel storage and dispensing facility able to both recover the gaseous hydrocarbons coming from the tank and to prevent the contamination of the tank with water coming from the outside air, while enabling a detecting of malfunctions of the fuel vapor recovery system.

In particular, it enables a detecting of losses in the pipelines of the vapor recovery system between the fuel dispenser and the tank.

The invention also enables a quantification of the abnormal fuel losses, such as those due to fraud or a leakage of fuel.

The invention claimed is:

1. A facility for storing and dispensing fuel, comprising:

a fuel storage tank (2) equipped with a vent pipe (3) and connected to at least one fuel dispenser (1) on the one hand by a fuel dispensing system (26) in a vehicle tank and, on the other hand, by a vapor recovery system (10) which aspirates the fuel vapor emitted during a dispensing of fuel in this tank, and a condensation/separation device (4) connected to the vent pipe (3) and allowing fuel vapor coming from the storage tank (2) to be condensed in order to generate condensed fuel and water coming from the outside air to be condensed in order to generate condensed water, said condensation/separation device (4) being connected to a condensed fuel evacuation line (5) connected to the storage tank (2) and to a condensed water evacuation line (6) to the outside, characterized in that it comprises:

at least one detection means (7, 8) cooperating with the condensation/separation device (4) for detecting the presence of condensed fuel and/or condensed water in said device and generating and transmitting a warning signal in response to said detection, and a control device (9) receiving said warning signal and transmitting, in response, information concerning the malfunction of the fuel vapor recovery system (10) to a control center (24).

2. The facility according to claim 1, characterized in that the condensation/separation device (4) comprises on the one hand a condenser (13) which condenses at the same time the fuel vapor coming from the storage tank (2) and the water coming from the outside air and on the other hand a separator (14) connected to said condenser and comprising two outlets, namely, a first outlet (15) connected to the condensed fuel evacuation line (5) and a second outlet (16) connected to the condensed water evacuation line (6).

3. The facility according to claim 2, characterized in that the two outlets (15, 16) of the separator (14) are each equipped with an automatically controlled valve cooperating with a condensate detector making it possible to detect the nature of the condensate contained in this separator (14), namely, a first valve (19) able to open or close the first outlet (15) connected to the condensed fuel evacuation line (5) and a second valve (20) able to open or close the second outlet (16) connected to the condensed water evacuation line (6), according to the nature of the condensate detected.

4. The facility according to claim 1, characterized in that the condensation/separation device (4) comprises on the one hand a fuel vapor condenser (21) able to condense the fuel vapor coming from the storage tank (2) and having an outlet connected to the condensed fuel evacuation line (5), and on the other hand a dehumidifier (22) able to condense the water coming from the outside air and having an outlet connected to the condensed water evacuation line (6).

5. The facility according to claim 2, characterized in that it comprises a single detection means (7) composed of a volume meter, such as a flow meter installed between the condenser (13) and the separator (14) and generating and transmitting a warning signal in response to the measurement of a volume of condensed fuel or condensed water.

6. The facility according to claim 2, characterized in that it comprises at least one detection means (7) installed in the separator (14) and generating and transmitting a warning signal in response to the detection of a predefined volume of condensate in this separator.

7. The facility according to claim 2, characterized in that it comprises two detection means, namely, a first detection means (7) connected to the condensed fuel evacuation line (5) and generating and transmitting a warning signal for excess pressure in response to the detection of condensed fuel in the condensed fuel evacuation line (5) and a second detection means (8) connected to the condensed water evacuation line (6) and generating and transmitting a warning signal for underpressure in response to the detection of condensed water in the condensed water evacuation line (6).

8. The facility according to claim 6, characterized in that the detection means comprise (each comprise) a gauge having a float movable between a low level and a high level and a contactor which is activated when the high level is reached, triggering the warning signal.

9. The facility according to claim 7, characterized in that each of the gauges is equipped with a valve at its outlet, opening when the float is at the high level so as to evacuate a known volume of condensate.

* * * * *